US009612018B2

(12) United States Patent
Bettinzoli

(10) Patent No.: US 9,612,018 B2
(45) Date of Patent: Apr. 4, 2017

(54) GAS BURNER FOR DOMESTIC COOKTOP

(71) Applicant: SABAF S.p.A., Ospitaletto (BS) (IT)

(72) Inventor: Angelo Bettinzoli, Concesio (BS) (IT)

(73) Assignee: SABAF S.P.A., Ospitaletto (BS) (IT)

( * ) Notice: Subject to any disclaimer, the term of this patent is extended or adjusted under 35 U.S.C. 154(b) by 214 days.

(21) Appl. No.: 13/878,371

(22) PCT Filed: Jan. 30, 2013

(86) PCT No.: PCT/EP2013/000277
§ 371 (c)(1),
(2) Date: May 10, 2013

(87) PCT Pub. No.: WO2013/113497
PCT Pub. Date: Aug. 8, 2013

(65) Prior Publication Data

US 2014/0090636 A1 Apr. 3, 2014

(30) Foreign Application Priority Data

Feb. 1, 2012 (CN) ..... 2012 2 0031884 U
Feb. 1, 2012 (IN) ..... 110/KOL/2012

(51) Int. Cl.
*F24C 3/08* (2006.01)
*F23D 14/06* (2006.01)

(52) U.S. Cl.
CPC ..... *F24C 3/08* (2013.01); *F23D 14/06* (2013.01)

(58) Field of Classification Search
CPC ..... F24C 3/08; F24C 3/082; F24C 3/085
USPC ..... 126/39 E, 39 R, 39 N, 39 K, 39 H
See application file for complete search history.

(56) References Cited

U.S. PATENT DOCUMENTS

| | | | | |
|---|---|---|---|---|
| 3,809,055 | A * | 5/1974 | Craver | F24C 3/085 126/214 R |
| 4,986,254 | A * | 1/1991 | Haen | A47J 37/0713 126/39 R |
| 5,152,276 | A * | 10/1992 | Brock et al. | 126/39 E |
| 6,132,205 | A * | 10/2000 | Harneit | 431/354 |
| 2006/0180137 | A1* | 8/2006 | McDonald | 126/25 R |
| 2008/0202494 | A1* | 8/2008 | Paesani | 126/39 E |
| 2010/0206293 | A1* | 8/2010 | Padgett et al. | 126/39 E |

FOREIGN PATENT DOCUMENTS

| | | | |
|---|---|---|---|
| CN | 201293361 | Y | 8/2009 |
| EP | 2090826 | A1 | 8/2009 |
| EP | 2182293 | A1 | 5/2010 |
| EP | 2216595 | A2 | 8/2010 |
| WO | 2006/077058 | A1 | 7/2006 |

* cited by examiner

*Primary Examiner* — Avinash Savani
*Assistant Examiner* — Vivek Shirsat
(74) *Attorney, Agent, or Firm* — Lucas & Mercanti, LLP

(57) ABSTRACT

A gas burner for a domestic cooktop of the type having a burner cup suitable to be fixed to the cooktop and provided with at least part of the structure for at least one primary-air gas mixer, a burner body that may be joined to the burner cup, the burner body having at least part of the structure for at least one primary air-gas mixture delivery chamber, and a burner cover that may be joined to the burner body to complete the at least one primary-air gas mixture delivery chamber, as web as at least one flame-spreader that is made in one piece with the burner cover. Advantageously, the burner cover and the at least one flame-spreader are made of a steel, or iron, or iron-alloy sheet.

12 Claims, 3 Drawing Sheets

GAS BURNER FOR DOMESTIC COOKTOP

CROSS-REFERENCE TO RELATED APPLICATION

This application is a 371 of PCT/EP2013/000277, filed Jan. 30, 2013, which claims the benefit of Indian Patent Application No. 110/KOL/2012, filed Feb. 1, 2012, and Chinese Patent Application No. 201220031884.3, filed Feb. 1, 2012, the contents of all of which are incorporated herein by reference.

FIELD OF THE INVENTION

The present invention refers to a gas burner for a domestic cooktop, of the kind comprising a burner cup suitable to be fixed to the cooktop and provided with the structure for at least one primary air-gas mixer, a burner body that may be joined to the burner cup and it is provided with at least part of the structure for a primary-air gas mixture delivery chamber, and a burner cover that may be joined to the burner body in order to fully define said at least one primary-air gas mixture delivery chamber, as well as at least one flame-spreader that is made in one piece with the burner cover.

BACKGROUND ART

It is well known in the art to make gas burners for a domestic cooktop with a simplified structure, wherein said burner comprises three separate pieces that may be mutually and reversibly joined.

More in detail, said three pieces of such a type of gas burner are a burner cup, that is provided with means for fixing to a relevant aperture cut in the cooktop, as well as with a primary air-gas mixer usually in the form of a Venturi tube, a central burner body in fluidic communication with the primary air-gas mixer and provided with the structure of a delivery chamber for the primary air-gas mixture, and a burner cover provided with at least one flame-spreader in fluidic communication with said delivery chamber.

The aforesaid burner cover is usually made by molding brass and then, once the brass burner cover is molded, by piercing holes and/or slits therein in order to get said flame-spreader made in one piece with the same burner cover.

Burner covers, with flame-spreaders made in one piece therewith, that are produced in brass are usually well resistant to possible deterioration due to heat and they prove to be not excessively expensive to manufacture, due to the low cost of brass.

Anyway, it has been ascertained that said burner covers with flame-spreaders made in brass are not particularly effective and thus they lead to gas burners with a low efficiency that needs to be improved.

Moreover, said brass-made burner covers with flame-spreaders can be easily scratched during use and they cannot be enameled, though they can at least be varnished with low-resistance paints.

It is therefore an object of the present invention to provide a gas burner for domestic cooktops of the type above mentioned, and particularly a gas burner in three pieces with the relevant burner cover integral to at least one flame-spreader, that doesn't show the drawbacks of the afore-cited prior art and thus that is more efficient than the gas burners of the same kind known in the art.

It is hence an object of the present invention to provide a gas burner for domestic cooktops that shows a simplified structure, it is not expensive to manufacture and, at the same time, is highly effective.

Another object of the present invention is to furnish a gas burner for domestic cooktops that is easy to make and that may be designed such a way it produces a high thermal power, without too many power losses.

A further object of the present invention is to provide a gas burner for domestic cooktops having a burner cover with flame-spreader(s) integral therewith that is more resistant to scratches and that it may be coated by enameling.

SUMMARY OF THE INVENTION

These and other objects are achieved by the gas burner for a domestic cooktop according to the independent claim 1 and to the subsequent claims dependent thereof. The gas burner for a domestic cooktop according to the present invention comprises a burner cup suitable to be fixed to said cooktop and provided with at least part of the structure for at least one primary-air gas mixer, a burner body that may be joined to the burner cup, said burner body comprising at least part of the structure for at least one primary air-gas mixture delivery chamber, and a burner cover that may be joined to the burner body in order to complete said at least one primary-air gas mixture delivery chamber, as well as at least one flame-spreader that is made in one piece with the burner cover. Advantageously, the burner cover, with said at least one flame-spreader, is made by a metal sheet in steel or iron or iron-alloy.

As the Applicant has ascertained, the use of a burner cover made by a steel or iron metal sheet, preferably having thickness ranging from 0.5 to 3 mm, in a gas burner of the kind above mentioned proves to be very effective and leads to a gas burner that is more efficient than similar gas burners with burner cover and flame-spreader(s) made in brass.

According to a preferred embodiment of the present invention, the gas burner comprises two ring-shaped concentric flame-spreaders made in one piece with said burner cover, this latter being preferably made by cold forging of said metal sheet.

Such an embodiment of the present invention, preferably with the provision of at least one axial Venturi tube as a primary air-gas mixer, allows the production of a high power and high effectiveness gas burner for domestic cooktops.

According to another preferred embodiment of the present invention, said at least one primary air-gas mixer of the gas burner herein claimed is an axial Venturi tube entirely made in the burner cup, and the burner body comprises at least one transit opening that fluidly connects the outflow end section of the axial Venturi tube to said primary-air gas mixture delivery chamber. Said transit opening is arc shaped and preferably extends for an angle less than, or equal to, 60°.

When such a solution is implemented, according to another embodiment of the present invention, the gas burner may further comprise centering means for placing in a proper position the burner cover, with its at least one flame-spreader, having regard to the burner body. In this case the flame-spreader may comprise slits and/or holes cut in correspondence or proximate to the aforesaid transit opening, each of these slits and/or holes having outflow area smaller that the outflow area of each of the other slits and/or holes cut far away from said transit opening.

It should be noted that with the terms "hole" and/or "slit" it is herein meant any aperture, made in a gas burner flame-spreader, having circular, rectangular or any other shape that is suitable to allow the combustible mixture (i.e. the primary air-gas mixture) to flow out of the burner such a way it can be fired.

Last but not least, according to another preferred embodiment of the present invention, the flame-spreader made in one piece with the burner cover, as well as the burner cover, may at least partly be enameled.

Enameling of the burner cover with the relevant flame-spreader(s) makes such a component more resistant to scratches and allows the burner cover with flame-spreader(s) to be colored as commonly required by the market.

BRIEF DESCRIPTION OF THE DRAWINGS

These and other aspects of the present invention will be apparent to the skilled person by the following description of a preferred embodiment of this invention—provided as a non-limiting example thereof—with the aid of the enclosed figures, wherein.

DETAILED DESCRIPTION OF A PREFERRED EMBODIMENT OF THE PRESENT INVENTION

Figure 1:
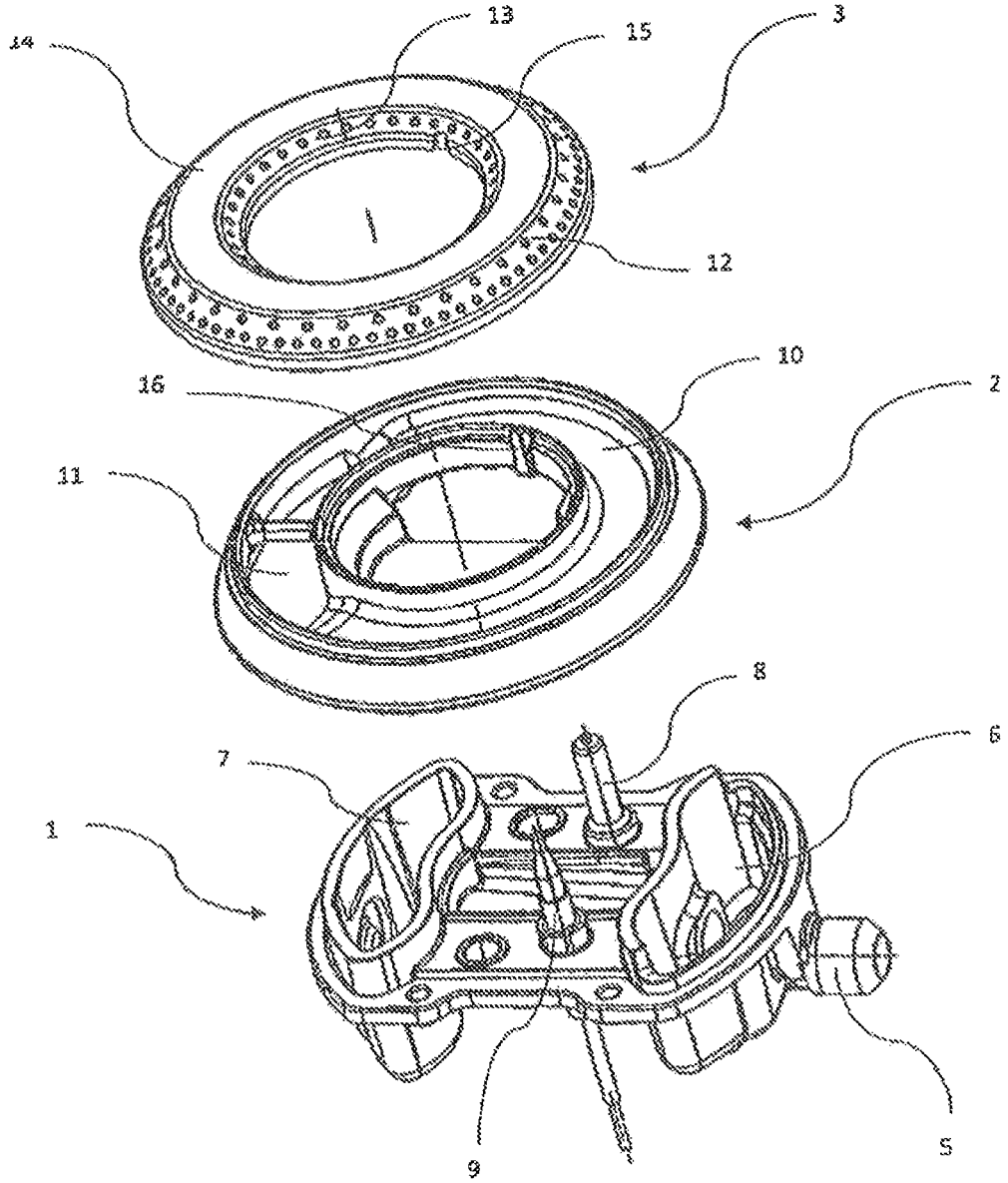
FIG. 1 is an exploded view of a gas burner for domestic cooktops according to a preferred embodiment of the present invention.

With reference in general to the enclosed figures, the gas burner for a domestic cooktop 100, according to a preferred embodiment of the present invention, comprises a burner cup 1 provided with the structure for at least one primary air-gas mixer 4 and with means 19 for its fixing to the cooktop 100, a burner intermediate body 2 that is so shaped to be detachably fitted to the burner cup 1 and that is provided with part of the structure of a delivery chamber 10 for the combustion mixture (i.e. the primary air-gas mixture), and a burner cover 3 that is suitable to be fitted to said burner body 2, on the top thereof, in order to fully complete said delivery chamber 10, and that comprises two flame-spreaders 12, 13, made in the same burner cover 3.

Advantageously, according to the present invention, said burner cover 3 with the embodied flame-spreaders 12, 13 is made by bending (preferably by cold forging) a metal sheet, wherein said sheet is a steel or iron, or iron-alloy, thin sheet, preferably having thickness ranging from 0.5 mm to 3 mm.

As can be described more in details later, said burner cover 3 with flame-spreaders 12, 13 integral thereto, according to a preferred embodiment of the present invention, may also be—at least partly—enameled in order to be more resistant to scratches and, at the same time, to be colored at will.

More in details, the gas burner shown in the figures comprises a burner cup 1 provided with an axial Venturi tube 4, having a substantially horizontal axis, that acts as a primary air-gas mixer for the gas burner, a first aperture 6 for the intake of primary air, that is in fluidic communication with the inflow section of the Venturi tube 4, as well as a second aperture 7, that is in fluidic communication with the outflow section of the Venturi tube 4, and it is suitable to be fluidly coupled to said delivery chamber 10 of the burner body 2.

The first aperture 6 (see FIG. 2) is so shaped to have a free section that is in fluidic communication with the external environment when the burner body 2 is coupled to the burner cup 1, such a way primary air may be sucked within the same gas burner, due to the Venturi effect produced when a combustible gas is injected within the Venturi tube 4.

It should be noted that even if it is herein described one axial Venturi tube as a primary air-gas mixer of the gas burner, any other number and/or known type of primary air-gas mixer (e.g. a radial Venturi mixer) may be alternatively implemented as well without departing from the claimed scope of this invention.

The burner cup 1 also comprises a gas nozzle 17 (see again FIG. 2) that injects a combustible gas, coming from a gas network attached to the burner cup 1 by means of a relevant entrance 5, towards the inlet section of the Venturi tube 4, where it mixes with the primary air coming from the first aperture 6 of the burner cup 1 in order to form said combustible mixture flowing out through the outflow section of the Venturi tube 4 and hence through said second aperture 7.

Figure 3:
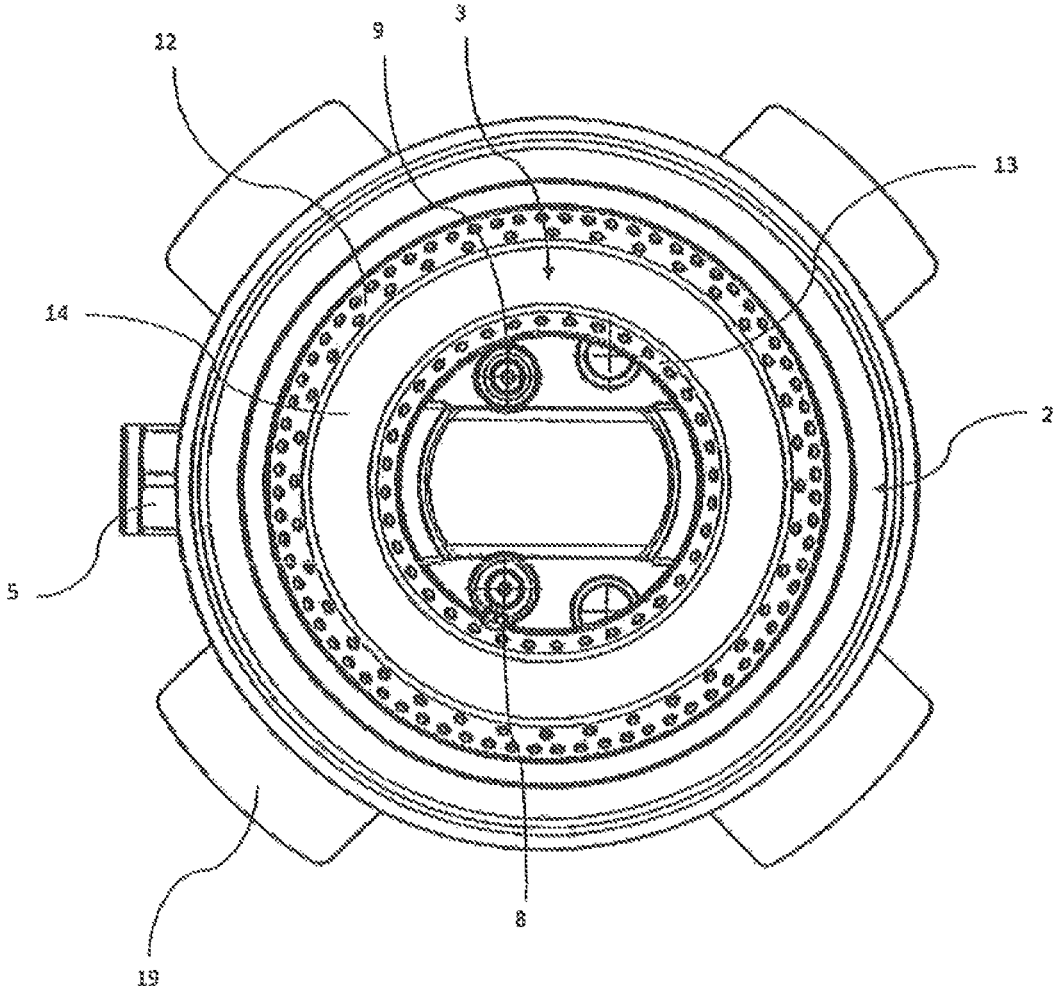
FIG. 3 is a top plane view of the gas burner shown in FIGS. 1 and 2.

The burner cup 1 is fixed to the edges of a proper aperture made in the cooktop 100 thanks to said means for fixing 19 that comprises, in the preferred embodiment of this invention herein illustrated, resilient clips (e.g. four resilient clips, as shown in FIG. 3), as well as threaded fixing means. The burner cup 1 is also provided with projecting check walls for allowing the correct coupling of the burner intermediate body 2 onto the same burner cup 1.

Moreover, onto the burner cup 1 are housed a spark plug 8 and a thermocouple 9 which are placed such a way they are proximate to a flame-spreader (the inner flame-spreader 13 in the gas burner herein illustrated) when the gas burner is fully assembled.

The burner intermediate body 2 of the gas burner herein described, as particularly shown in FIG. 1, is a substantially ring-shaped body having an annular upper cavity defining part of a delivery chamber 10 for the combustion mixture. The delivery chamber 10 comprises a transit opening 11 that put in fluidic communication said second aperture 7 of the burner cup 1 with the same delivery chamber 10, i.e. the outflow section of the Venturi tube 4 with the latter.

Figure 2:
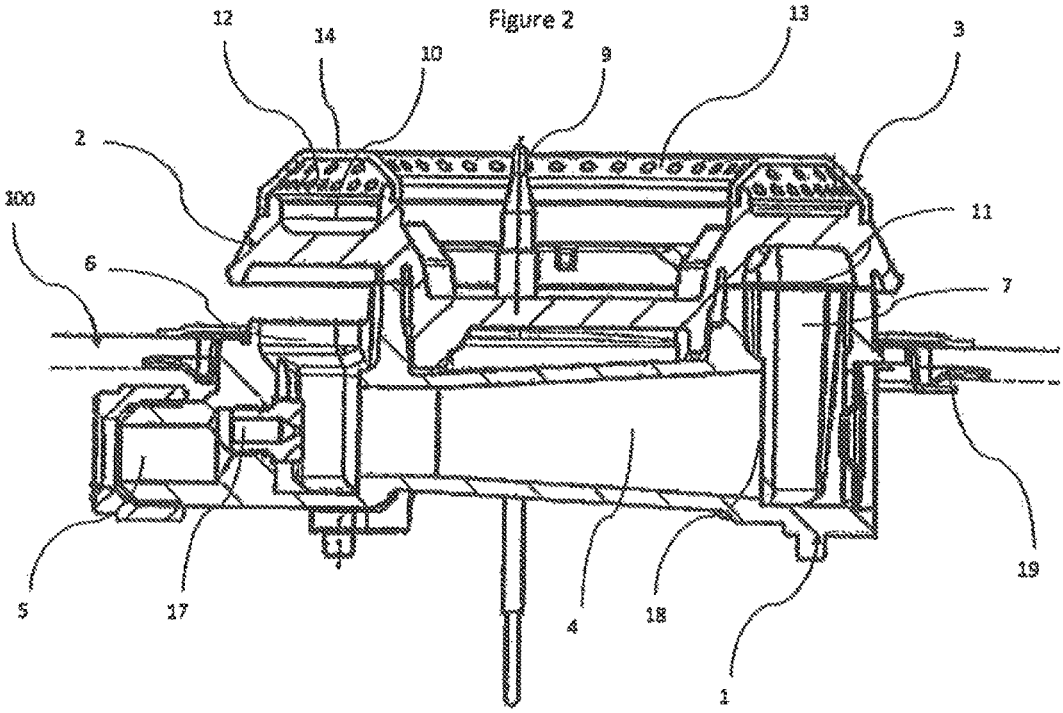
FIG. 2 is a side sectional view of the gas burner shown in FIG. 1.

The transit opening 11, as can be seen in FIG. 2, is arc shaped with a central reinforcing rib, and it extends for an angle less than, or at least equal to, 60°.

The burner body 2 is also shaped to be fitted to the burner cup 1, on the top region thereof, such a way the transit opening 11 coincides to the second aperture 7 and the spark plug 8 and the thermocouple 9 are properly placed within the burner.

The gas burner herein described also comprises a burner cover 3 that, in the preferred embodiment herein illustrated, is substantially ring shaped and it comprises one external and one internal side wall, as well as a top circular cap 14.

The burner cover 3 is provided with an external flame-spreader 12, made in said external side wall of the burner cover 3, and with an internal flame-spreader 13, made in the relevant internal side wall of the same burner cover 3. Said two flame-spreaders 12, 13 are thus annular and substantially mutually concentric.

As can be particularly seen in FIG. 1, the external flame-spreader 12 is made by two parallel rows of circular holes cut in the external side wall of the burner cover 3, while the internal flame-spreader 13 is made by only one row of circular holes cut in the internal side wall of the same burner cover 3.

The holes of the lower row of the external flame-spreader 12 are pilot flame holes, while the holes of the upper row of the external flame-spreader 12 are main flame holes. This means that the outflow area of the lower row holes of the flame-spreader 12 is generally lesser than the outflow area of the upper row holes of the same flame-spreader 12.

As already mentioned, even if circular holes cut in the burner cover for defining the gas burner flame-spreaders are herein described, any other shape of these holes may be implemented, e.g. rectangular slits, elliptical apertures, etc., without departing from the scope of this invention, as hereinafter claimed.

It should also be noticed that, even if a gas burner having two flame-spreaders made in the burner cover is herein depicted and described, any other gas burner having at least one flame-spreader made in one piece with said burner cover is intended to be within the scope of protection of the appended claims.

The burner cover 3 is so shaped that it can be fitted to the upper part of the burner intermediate body 2, such a way the delivery chamber 10 for the combustible mixture, partially defined in said burner body 2, is completed by the top cap 14 of the burner cover 3, as well as by the external and internal side walls thereof with the relevant flame-spreaders 12, 13. In this way, said delivery chamber 10 may be fed, via the transit opening 11, with the combustible mixture coming from the outflow section of the Venturi tube 4 and the second outflow opening 7 of the burner cup 1. Such a combustible mixture thus fills the whole inner space of the same delivery chamber 10 and outflows from the holes of the flame-spreaders 12, 13 cut in the burner cover 3.

As above partially described, the burner cover 3 of the gas burner shown in the figures, according to a preferred embodiment of the invention, is advantageously made by a steel, or iron, or iron-alloy, sheet that is properly stamped, milled and cold forged, before the flame-spreader holes or slits are cut therein. The thickness of the metal sheet may preferably range from 0.5 mm to 3 mm.

The Applicant has in practice ascertained that the use of a steel, or iron, or an iron-alloy, sheet, with thickness preferably ranging from 0.5 mm to 3 mm, for the burner cover 3, with the relevant flame-spreader(s), leads to a low cost, highly effective gas burner of the kind described above.

In a preferred embodiment of the present invention, as already mentioned, the burner cover 3 with flame-spreaders 12, 13 may be, at least partly, enameled, such a way the burner cover 3 and/or the flame-spreaders 12, 13 are substantially protected from scratches and they may be colored according to the market requirements. In fact, coating the burner cover 3, as well as the relevant flame-spreaders 12, 13 integral thereto, with enamel prevents the user from scratching the steel, iron, or iron-alloy, sheet constituting said burner cover 3 and at the same time allows the gas burner to be more aesthetically pleasant.

It should be noticed that enameling of the burner cover 3, with the relevant flame-spreaders 12, 13, is allowed by the fact that such a burner cover with flame-spreaders 12, 13 is made by a steel, or iron, or iron-alloy sheet.

According to a preferred embodiment of the present invention, the burner intermediate body 2 and the burner cover 3 have centering means 15, 16 aiming at placing in a proper angular position the burner cover 3 having regard to the burner body 2, when the burner cover 3 is mounted on the latter. Such a centering means, in the gas burner shown in the figures (see FIG. 1), comprise a radial projecting tooth 16 made in the inner region of the burner body 2 and a complementary radial seat 15 likewise made in the inner region of the burner cover 3.

This allows to pierce holes of the flame-spreader 12, 13 with different outflow area as a function of their position along the burner cover side wall, such a way the outflow area of the holes intended to be placed in correspondence, or proximate, to the transit opening 11 of the delivery chamber 10 is smaller than the outflow area of the holes intended to be far away from said transit opening 11, when the burner cover 3 is assembled to the burner body 2.

Such a solution allows to keep substantially regular and uniform the flames coming out from the flame-spreaders 12, 13, along all their circumferential development. In fact, as can be easily understood by the skilled person, the combustion mixture flowing out from the transit opening 11 expands in the delivery chamber 10 and therefore its pressure (slightly) decreases as long as it expands: this means that the pressure of the combustion mixture in correspondence, or proximity, to the transit opening 11 is (slightly) higher than the pressure of the same combustion mixture in regions of the delivery chamber 10 that are far away from said transit opening 11. Therefore, in order to balance such a pressure difference and thus to avoid irregular flames coming out from the flame-spreaders 12, 13, holes of the same flame-spreader 12, 13 with different outflow areas are cut in the burner cover 3, as above described. Assembly and operation of the gas burner herein described are common.

After fixing the burner cup 1 to the relevant aperture cut in the cooktop 100, thanks to the fixing means 19, the burner intermediate body 2 is placed atop the burner cup 1 such a way the transit opening 11 substantially coincides to said second aperture 7, for the outflow of the combustible mixture, of the same burner cap 1. It should be noticed (see FIG. 2) that assembly of the burner body 2 onto the burner cup 1 keeps open to the external environment at least part of the aforesaid first aperture 6, for the intake of primary air, of the same burner cup 1.

Assembly of the gas burner herein described is completed by placing on the top region of the burner intermediate body 2 the burner cover 3 with the relevant flame-spreaders 12, 13, such a way the projecting tooth 16 of the burner body 2 couples to the relevant seat 15 cut in the burner cover 3.

In this way, the combustion mixture delivery chamber 10 is completed and the holes with smaller outflow area of the flame-spreaders 12, 13 are placed in correspondence, or proximity, to the transit opening 11 of the same delivery chamber 10, while the holes with larger outflow area of the flame-spreaders 12, 13 are placed far away from said transit opening 11.

Operation of the gas burner in the figures is the following.

Combustible gas is injected by the nozzle 17 within the axial Venturi tube 4 where it mixes with primary air sucked within the same axial Venturi tube from the intake first aperture 6 of the burner cup 1, thanks to the well-known Venturi effect.

Once the primary air-gas combustible mixture is formed, at the outflow section of the same Venturi tube 4, such a combustible mixture outflows from the second aperture 7 of the burner cup 1 and, via the transit opening 11, expands in said delivery chamber 10.

From the delivery chamber 10 the combustible mixture outflows from the holes of the flame-spreaders 12, 13 where it is fired by the spark plug 8. The thermocouple 9, in a well known manner, allows a safety operation of the gas burner.

As the Applicant has ascertained, the above described gas burner, according to a preferred embodiment of the present invention, proves to be economical to manufacture, suitable to furnish high thermal power, and highly effective.

The invention claimed is:

1. A gas burner for a domestic cooktop, of the type comprising:

a burner cup suitable to be fixed to said cooktop and provided with at least part of the structure for at least one primary-air gas mixer, a burner body joined to said burner cup, said burner body comprising at least part of the structure for at least one primary air-gas mixture delivery chamber, a burner cover joined to said burner body to complete said at least one primary-air gas mixture delivery chamber, as well as at least one flame-spreader that is made in one piece with said burner cover, wherein said burner cover and said at least one flame-spreader are made of a steel, or iron, or an iron-alloy sheet, and wherein said steel or iron or iron-alloy sheet is a bent sheet that has thickness ranging from 1.3 to 3 mm, and centering means for said burner cover, wherein said at least one primary air-gas mixer is a Venturi tube having a longitudinal axis aligned horizontally and along which a gas and air mixture flows, said Venturi tube being made in said burner cup, said burner body comprising at least one transit opening fluidly connecting the outflow section of said Venturi tube to said primary-air gas mixture delivery chamber, and wherein said at least one flame-spreader comprises at least one of holes and slits that vary in outflow area, such that the at least one of holes and slits of the at least one flame-spreader proximate to said transit opening have the smallest outflow area and the at least one of holes and slits of the at least one flame-spreader furthest from said transit opening have the greatest outflow area when the at least one flame-spreader is centered on said burner body by said centering means.

2. A gas burner according to claim 1, wherein said at least one flame-spreader is substantially ring-shaped.

3. A gas burner according to claim 1, of the type comprising two ring-shaped concentric flame-spreaders, wherein said two flame-spreaders are made in one piece with said burner cover.

4. A gas burner according to claim 1, wherein said at least one flame-spreader comprises a plurality of circular holes.

5. A gas burner according to claim 1, wherein said transit opening is arc shaped and extends for an angle less than, or equal to, 60°.

6. A gas burner according to claim 1, wherein said at least one flame-spreader comprises at least a lower row of pilot flame holes and/or slits, and an upper row of main flame holes and/or slits.

7. A gas burner according to claim 1, wherein said at least one cover is at least partly enameled.

8. A gas burner according to claim 1, wherein said at least one flame-spreader that is made in one piece with said burner cover is at least partly enameled.

9. A gas burner according to claim 1, wherein said centering means comprise a radial projecting tooth made in the inner region of the burner body and a complementary radial seat made in an inner region of the burner cover.

10. A gas burner according to claim 3, wherein the two ring-shaped concentric flame-spreaders include an external flame spreader made by two parallel rows of circular holes cut in the external side wall of the burner cover.

11. A gas burner according to claim 10, wherein an outflow area of a lower row of holes of the external flame spreader is less than an outflow area of an upper row holes of the external flame spreader.

12. A gas burner according to claim 3, wherein the two ring-shaped concentric flame-spreaders include an internal flame spreader made by one row of circular holes cut in the internal side wall of the burner cover.

* * * * *